US005317876A

United States Patent [19]

Nakagawa et al.

[11] Patent Number: 5,317,876

[45] Date of Patent: Jun. 7, 1994

[54] SOUND WAVE OPERATED ENERGY CORVERTER FOR PRODUCING DIFFERENT FORMS OF MOVEMENT

[75] Inventors: Katsumi Nakagawa, Tsuchiura; Yasuo Kuwabara, Nagoya; Koji Nishida, Anjo, all of Japan

[73] Assignee: Aisin Seiki Kabushiki Kaisha, Kariya, Japan

[21] Appl. No.: 995,680

[22] Filed: Dec. 23, 1992

[30] Foreign Application Priority Data

Dec. 26, 1991 [JP] Japan ..... 3-345031

[51] Int. Cl.[5] ..... F15B 21/12

[52] U.S. Cl. ..... 60/532; 91/DIG. 1

[58] Field of Search ..... 60/532, 519, 389; 416/6, 223 R; 91/DIG. 1, DIG. 4, 1; 92/5 R

[56] References Cited

U.S. PATENT DOCUMENTS

Re. 28,434 5/1975 Olsen ..... 60/532
2,111,036 3/1938 Wippel ..... 60/532
2,181,120 11/1939 Dake .
2,608,623 8/1952 Cutler et al. .
2,616,984 11/1952 Paré .
3,027,876 4/1962 Strick .
3,182,457 5/1965 Sato et al. ..... 60/532
3,511,050 5/1970 Taberner .
5,145,333 9/1992 Smith .

FOREIGN PATENT DOCUMENTS 695722 11/1979 U.S.S.R. .
1100435 6/1984 U.S.S.R. .

*Primary Examiner*—Edward K. Look
*Assistant Examiner*—Hoang Nguyen
*Attorney, Agent, or Firm*—Burns, Doane, Swecker & Mathis

[57] ABSTRACT

An energy converter for converting a sound energy into a kinetic energy is comprised of a source device for radiating the sound energy, and a body having a cover member for absorbing the sound energy and a reflecting member mounted thereon with the cover member in such a manner that the sound energy after passing through the cover member reaches the reflecting member so as to be tangential thereto.

9 Claims, 9 Drawing Sheets

SOUND WAVE OPERATED ENERGY CORVERTER FOR PRODUCING DIFFERENT FORMS OF MOVEMENT

BACKGROUND OF THE INVENTION

The present invention relates to an energy converter, and in particular to a sound wave operated energy converter which can establish a rotational movement, a linear movement or other movement.

A conventional energy converter, which is pending in the United States Patent and Trademark Office under the Ser. No. of 07/917,964 (filing date: Jul. 24, 1992), is shown in FIGS. 13 and 14. The conventional energy converter includes a rotor 23 from which a plurality of equally pitched blades 23*a* are extended outwardly in the radial direction, and a cylindrical housing 21 in which the rotor 23 and blades 23*a* are arranged. At an inner surface of the housing 21, there are secured a plurality of equally pitched resonators 22 so as to surround the blades 23*a*. When each resonator 22 generates a sound wave, the resulting radiation or sound pressure affects the blades 23*a*, which brings a rotation of the rotor 23.

In the foregoing structure, whenever the blade 23*a* is substantially perpendicular to the direction along which radiation pressure is transmitted the former can receive the energy of the latter efficiently. Is the blade 23*a* makes an acute angle with respect to the foregoing direction after the foregoing rotation of the rotor 23*a*, the energy receipt at the blade 23*a* becomes less efficient.

SUMMARY OF THE INVENTION

It is, therefore, a primary object of the present invention to provide an energy converter without the foregoing drawback.

In order to attain the foregoing object, an energy converter for converting a sound energy into a kinetic energy is comprised of a source device for radiating the sound energy, and a body having a cover member for absorbing the sound energy and a reflecting member mounted thereon with the cover member in such a manner that the sound energy after passing through the cover member reaches the reflecting member so as to be tangential thereto.

BRIEF DESCRIPTION OF THE DRAWINGS

The above and other objects, features and advantages of the present invention will be more apparent and more readily appreciated from the following detailed description of a preferred exemplarily embodiment of the present invention, taken in connection with the accompanying drawings, in which.

DESCRIPTION OF THE PREFERRED EMBODIMENTS

Preferred embodiments of the present invention will be described hereinunder in detail with reference to the accompanying drawings.

Figure 1:
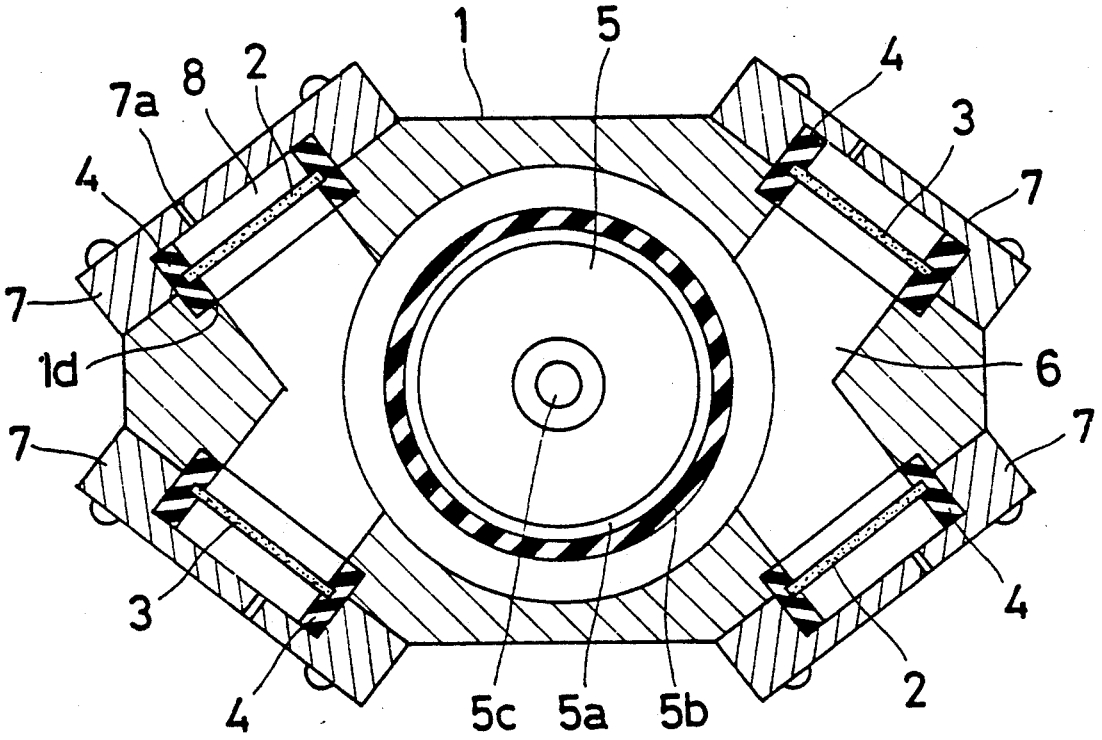
FIG. 1 is a plane cross-sectional view of an energy converter according to a first embodiment according to the present invention.
Figure 2:
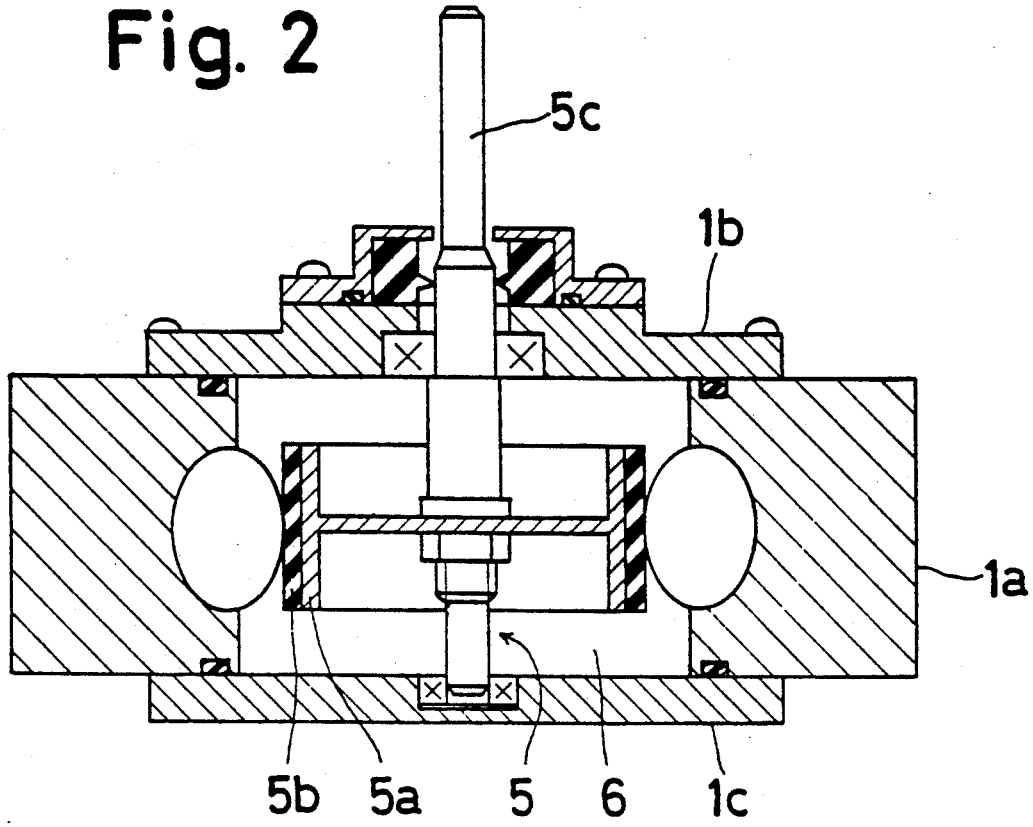
FIG. 2 is a vertical cross-sectional view of the device in FIG. 1.
Figure 3:
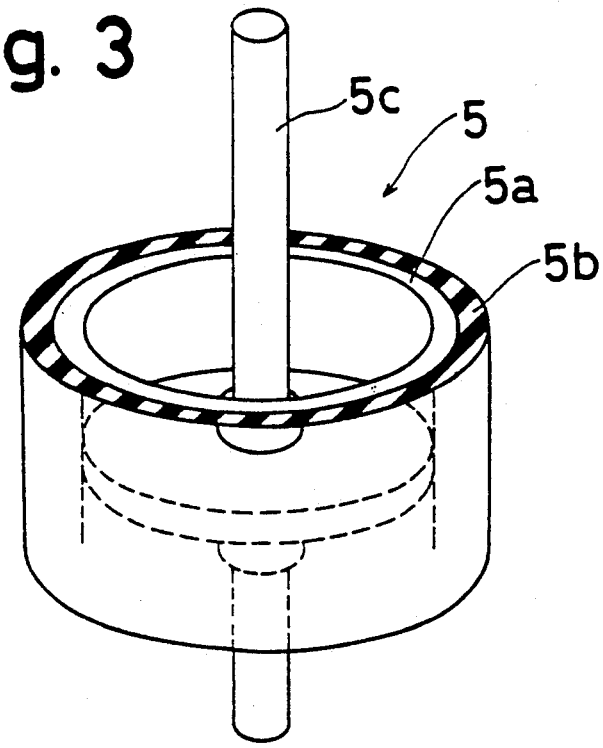
FIG. 3 is a perspective view of a rotor of the device in FIG. 1

Referring first to FIGS. 1 and 3, an energy converter which is in the form of a sound wave operated actuator includes a housing 1 which has a main body 1*a* having an inner space, an upper lid 1*b* closing an upper opened end of the inner space, and a lower lid 1*c* closing a lower end of the inner space. A plurality of windows 1*d* are formed in the main body 1*a*. Within the inner space of the housing 1, an amount of fluid 6 as a medium is filled.

A rotor 5 is accommodated within the inner space of the housing 1 and is rotatably supported at each of the lids 1*b* and 1*c*. The rotor 5 includes a cylindrical body 5*a*, a shaft 5*c* on which the cylindrical body 5*a* is fixedly mounted, and a cover member 5*b* which covers or surrounds the entirety of the outer surface of the cylindrical body 5*a*. The outer surface of the cylindrical body 5*a* serves for reflecting sound waves and the cover member 5*b* is set to absorb sound waves for the transmission thereof to the cylindrical body 5*a*.

A pair of diagonally spaced resonators 2 and another pair of diagonally spaced resonators 3, each of which is supported at the corresponding window 1*d* in a fluid-tight fashion by a rubber bush 4, are arranged in such a manner that two different resonators 2 and 3 are adjacent each other. A plate 7 with an aperture 7*a* is secured to the main body 1*a* of the housing 1 so as to close the respective window 1*d*, which results in that an air chamber 8 is defined which is in opposition to the fluid 6 via the resonators 2 (3). The air chamber 8 serves to effectively propagate the sound wave when the resonators 2 and 3 are turned on. If the actuator is desired to be used within air, the rubber bush 4 as a sealing means is not required. On the other hand, when the actuator is desired to be used within a liquid, the rubber bush 4 is an essential element as a sealing means. The illustrated embodiment shows the former case, and the air chamber 8 is, via the aperture 7*b*, in fluid communication with atmosphere.

If the actuator is set to used in liquid, by coinciding the same with the liquid 6, no effective seal between the housing 1 and the shaft 5*a* is required.

Each of the resonators 2 and 3 is adapted to emit or radiate, along its axial direction, the sound wave or sound beam so that the outermost portion thereof forms a tangent to the outer surface of the rotor 5. Each of the resonators 2 and each of the resonators 3 serve for rotating the shaft 5 in the positive direction and the negative direction, respectively.

In the present embodiment, a disk-shaped piezoelectric element is used for constituting each of the resonators 2 and 3. The piezoelectric element is made of PZT (lead zirconate titanate), is of 1.2 mm in thickness, and is so rated with a longitudinal resonance frequency of 1.7 MHz as to be used at an ultrasonic area.

Figure 4:
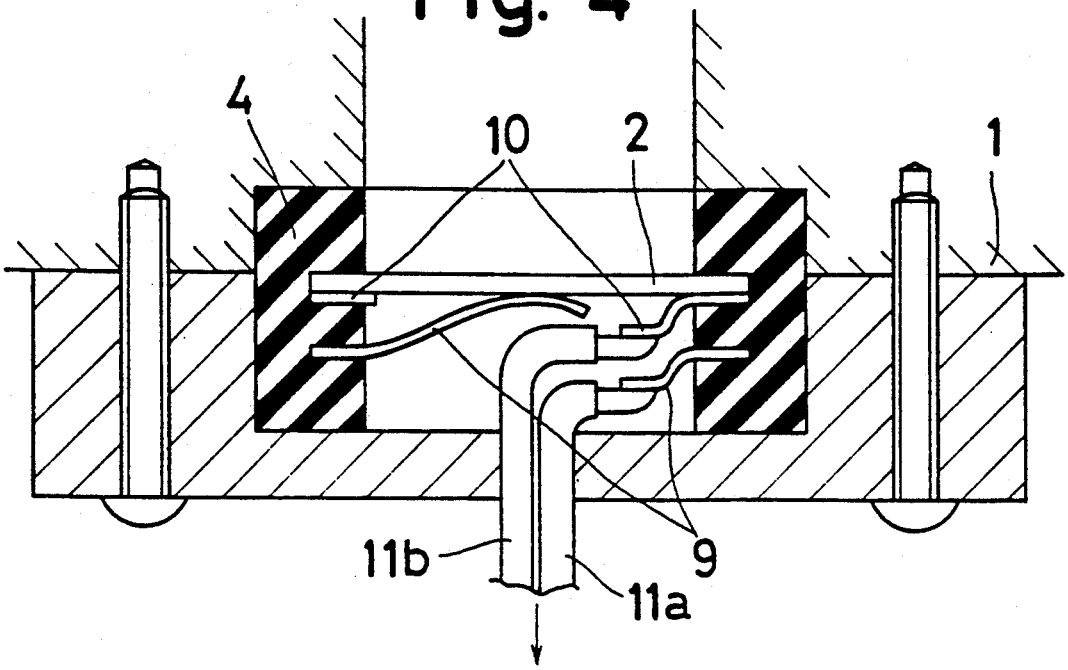
FIG. 4 is a view showing a neighbourhood of a resonator of the device in FIG. 1
Figure 5A:
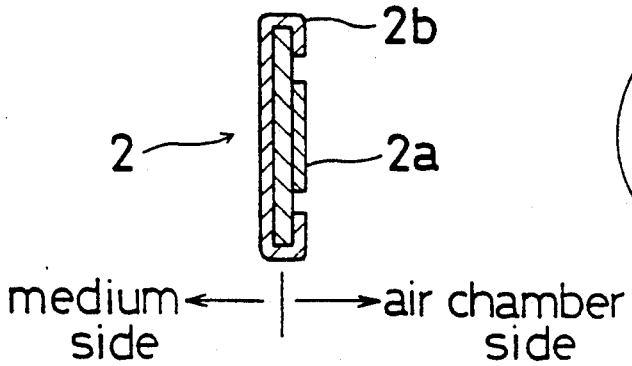
FIG. 5(A) is a side view of the resonator.
Figure 5B:
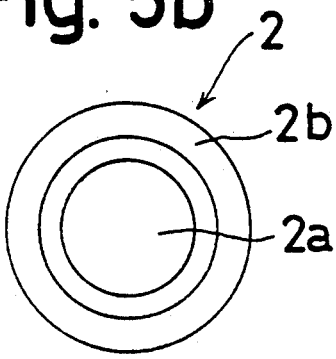
FIG. 5(B) is a plane view of the resonator.
Figure 6:
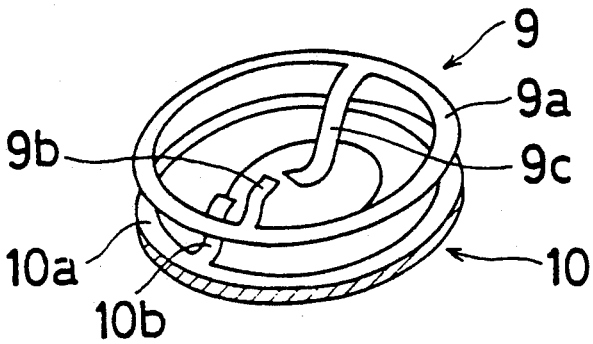
FIG. 6 is an exploded perspective view of the resonator including positive and negative electrodes.

Referring to FIG. 4, there is illustrated a detailed structure of a portion in the neighbourhood of the resonator 2. It is to be noted that similar structure can be seen in the resonator 3. The disk-shaped resonator 2 is surrounded by a positive electrode 9, a negative electrode 10, and the rubber bush 4. As shown in FIGS. 5(A) and 5(B), the resonator 2 has at its central portion and outer peripheral portion, respectively, a positive electrode 2*a* and a negative electrode 2*b*. The negative electrode 10 has, as shown in FIG. 6, an annular portion 10*a* and an inwardly extending terminal 10*b*. The annular portion 10*a* is in contact with the negative electrode 2*b* of the resonator 2 (the resonator 3). The terminal 10*b* of the negative electrode 10 is soldered with one end of a wire 11*b*. The positive electrode 9 has an annular portion 9*a* and a pair of opposed inward extending terminals 9*b* and 9*c*. The annular portion 9*a* is located in parallel with the resonator 2 (3) so as not to be in contact therewith. The terminal 9*b* of the positive electrode 9 is soldered with one end of the wire 11*a*. The terminal 9*c* formed in a spring mode is in contact with the positive electrode 2*a* of the resonator 2. The frequency of the sound wave at the resonator 2 is adjustable by controlling the voltage and/or current in the wires 11*a* and 11*b*. In light of the fact that the resonator 2(3) is within the liquid 6, for the prevention of deterioration of the resonator 2 (3), each of electrodes 2*a*, 2*b*, 3*a*, 3*b* is in the form of a thin film which is obtained by the sputtering manner or CVD method.

Figure 9:
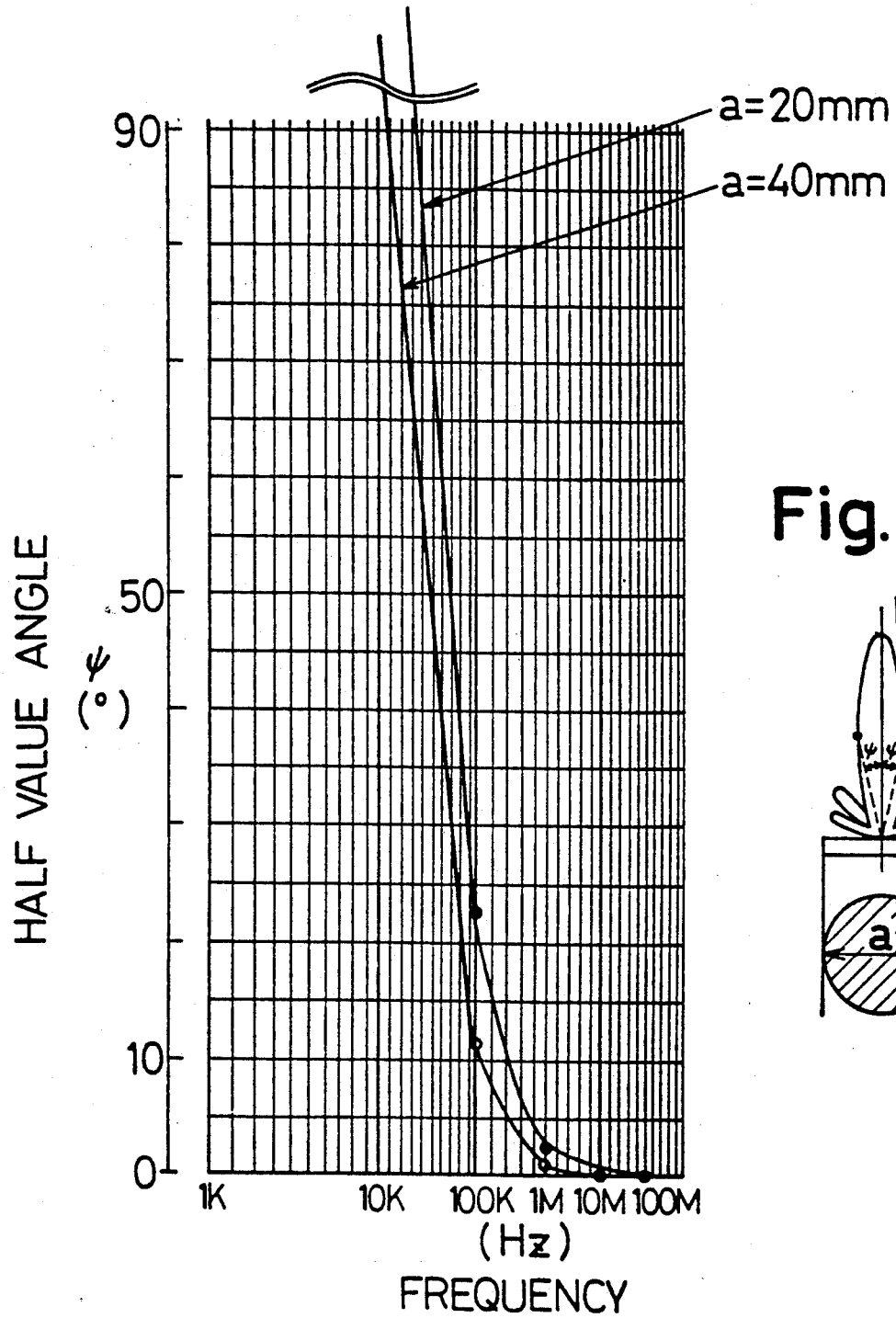
FIG. 9(A) shows a schematic operation principle of the device in FIG. 1.
FIG. 9(B) shows a graphic operation principle of the device in FIG. 1.
Figure 9:
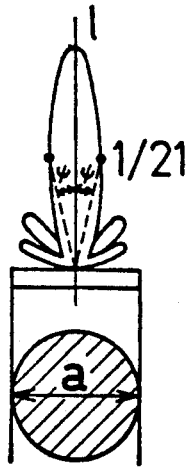
Figure 10:
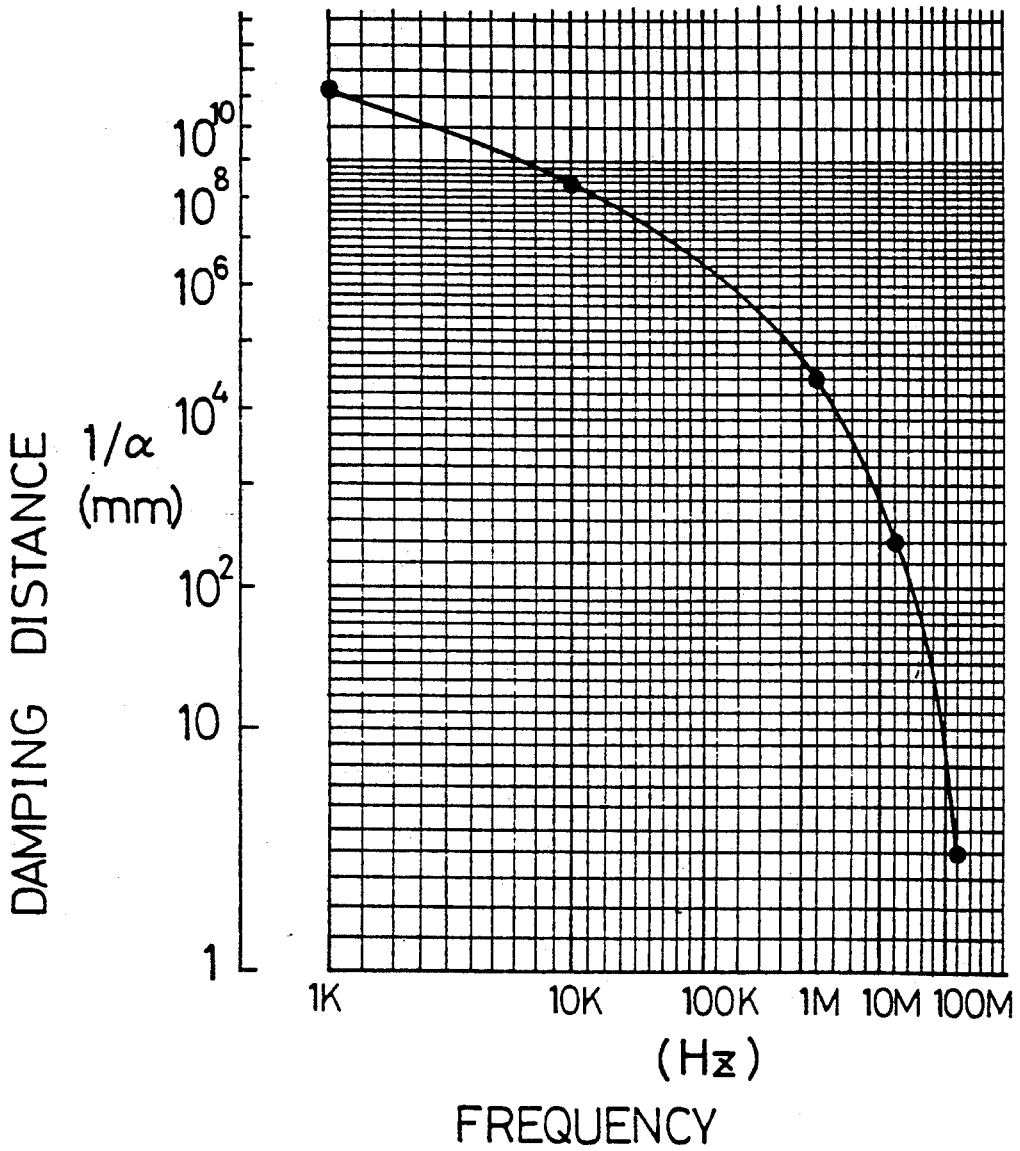
FIG. 10 shows another graphic operation principle of the device in FIG. 1.

A sound field as shown in FIG. 9(A) is established at a side of the liquid 6 by the vibration of the resonator 2. The sound energy flux density of the sound field extends along the axial direction of the resonator 2. Though the actual acoustic radiation pressure is as complicated as the sound wave distribution, in the case of the disk-shaped resonator having a diameter of 20 mm within the liquid medium, the sound wave caused by the vibrations of the disk-shaped resonator generates the sound field as illustrated in FIG. 9(B). When the frequency of the vibration of the disk-shaped resonator is approximately 1 MHz or more, the sound field exhibits a half value angle of about 2 through 3 degrees or less, and is formed like a beam. Thus, the sound field can be approximated to a plane progressive wave in practical use. On the other hand, when the frequency of the vibration of the resonator is high, there arises the damping or less. Thus, when the frequency of the vibration of the resonator is not less than 10 MHz, the damping distance is several tens of centimeters or less in liquid as shown in FIG. 10, which results in that it is preferable to operate or vibrate the resonator at a frequency ranging from 1 through 10 MHz in order to constitute an energy converter of a few centimeters through several tens of centimeters in size or scale.

Moreover, when a liquid is the radiation medium for the sound wave, it is possible to input a sound power which is larger by three digits than the case where a gas is the radiation medium for the sound wave. For instance, in the case where the PZT is used as the resonator, it is possible to input a sound power of 800 W/cm$^2$ into water, however, it is only possible to input a sound power of less than about 0.2 W/cm$^2$ into atmosphere. Hence, liquids are suitable for the medium. However, it is not appropriate to employ a liquid, which absorbs or damps the sound wave considerably, for the radiation medium. In addition, when a liquid is disposed at one side of the resonator and a gas is disposed at the other side of the resonator as is in the present embodiment, almost all of the energy generated by the resonator can be inputted into the liquid. In such a case, the electroacoustic efficiency reaches 90% or more.

Figure 11:
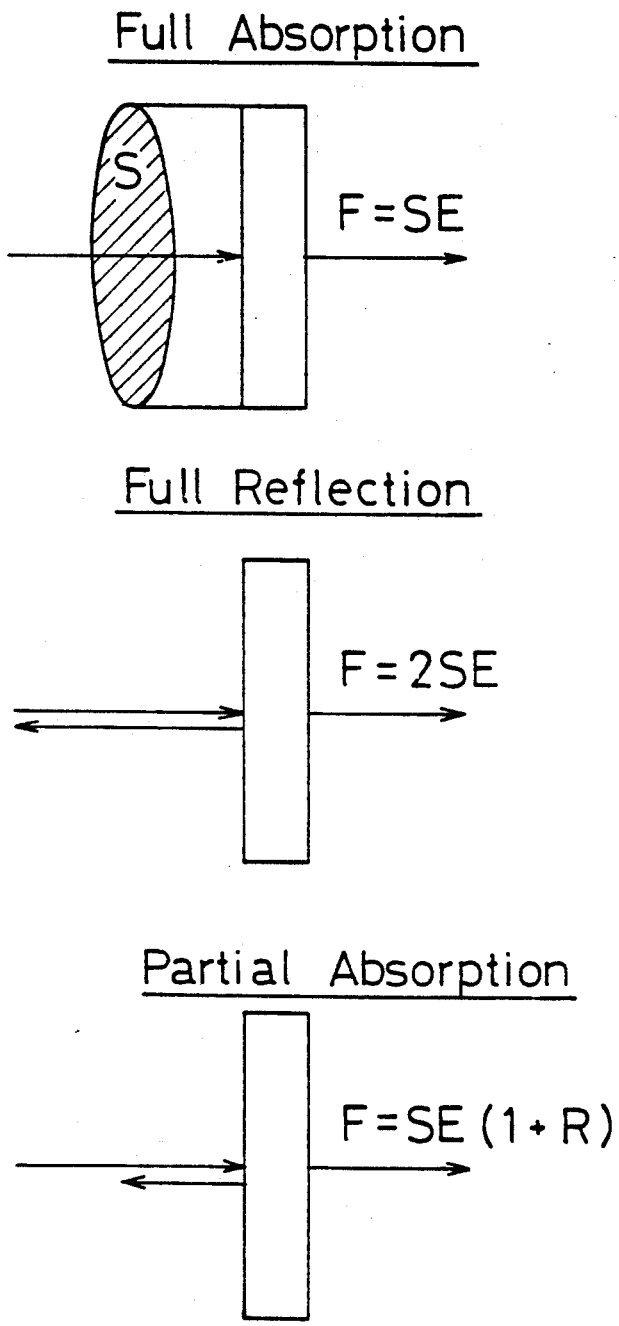
FIG. 11 is view explaining the operation of the device in FIG. 1.

The force F, which a substance receives from a radiation pressure when the substance is in limitless plane progressive sound field whose sound energy density is E, depends on the characteristics of the substance as shown in FIG. 11. If the area of the outer surface of a resonator is defined to be S, in the case where the substance possesses full absorption characteristics, the formula of $F=SE$ is established. In the case where the substance possesses full reflection characteristics, the formula of $F=2SE$ is established. If the substance possesses partial absorption characteristics, the formula of $F=SE(1+R)$, where R is the reflective rate of the sound intensity, is established. A rubber is the most popular as the absorption substance. Most substances possess partial absorption characteristics. The reflective rate R is related to the impedance of Z1 and Z2 of the medium and substance, respectively which establishes the formula of $((Z2-Z1)/(Z2+Z1))^2$. This rate becomes about 90% (about 70%) with the combination of water and SUS or stainless steel (water and Al or alminum).

Figure 7:
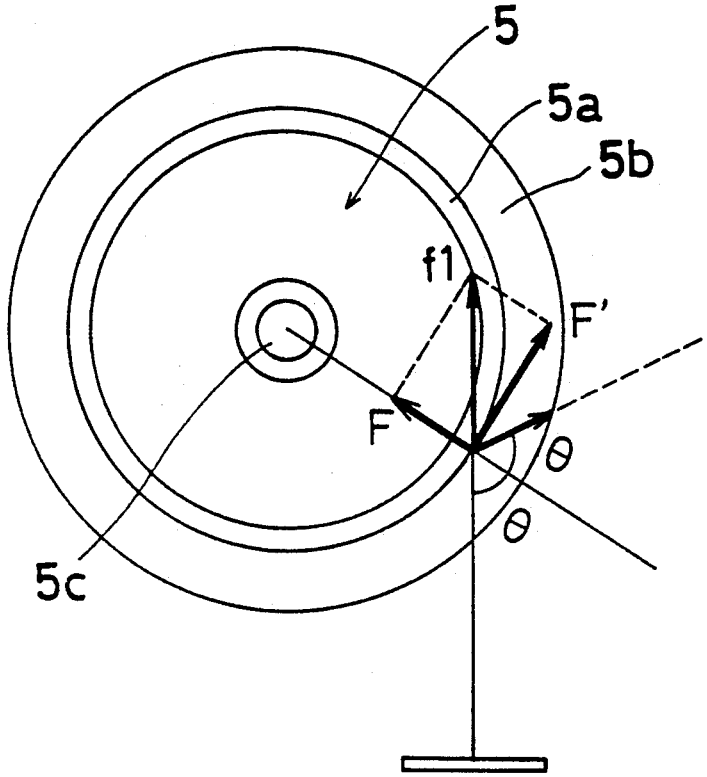
FIGS. 7 and 8 show a brief operation principle of the device in FIG. 1.

In the present embodiment, the sound wave is set to be emitted or radiated obliquely to the cover member 5*b* as the absorption element and the resulting wave is reflected by the outer surface of the cylinder 5*a*. By adjusting the raw material and thickness of the cover member 5*b* in such a manner that the sound wave may be substantially damped during its travel in the cover member 5*b*, a minimum reflected sound field can be established, which brings in that, as seen from FIG. 7, the cover member 5*b* receives only the radiation force f1 due to the incidence sound field near the outer surface of the cylinder body 5*a*. Thus, the foregoing structure enables the rotor 5 to receive at its outermost periphery the tangential component F' of the radiation force f1 due to the incidence sound field, resulting in that the maximum torque can be obtained. Without absorption element 5*b*, due to cancellation of both radiation forces in opposite directions, the rotor 5 remains fixed.

Figure 8:
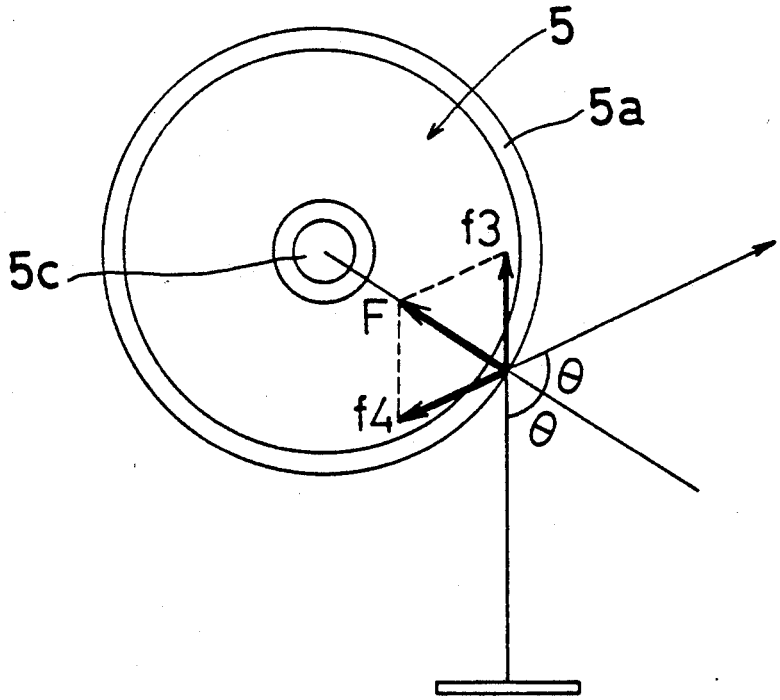

The cover member 5*b* is set to receive a force for rotating the rotor in the counter-clockwise direction by absorbing an energy from the resonator. The cover member 5*b* receives the force f1 upon incidence of the sound wave and the force f2 upon reflection thereof. The component of the forces f1 and f2 is applied to the rotor 5 in the tangential direction thereof, and results in a large rotating force or torque. It is to be noted that as seen in FIG. 8 the cylinder body 5*a* receives the force f3 upon incidence of the sound wave and the force f4 upon reflection thereof.

The transmission coefficient of the sound intensity in the cover member 5*b*, which is the reciprocal of the reflection coefficient thereof, is represented in the formula of $T=1-R=4Z1Z2/(Z1+Z2)^2$.

The sound impedance in water equals that in rubber, which leads to $R=0$ and $T=100\%$. In the light of the fact that the sound wave absorption and ability of rubber is high, the rubber is the most suitable for the cover 5b. In addition, the reflection coefficient of sound intensity is about 90% with the combination of water and stainless steel like the combination of water and SUS, which reveals that stainless steel is excellent as a raw material of the cylinder 5a.

Figure 12:
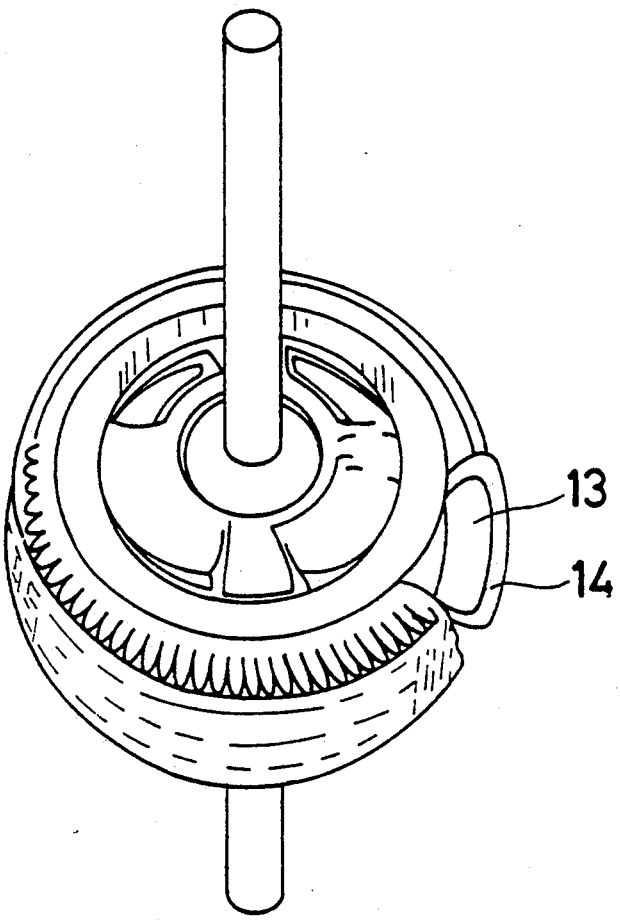
FIG. 12 is a perspective view of a rotor of a device according to a second embodiment of the present invention.
Figure 13:
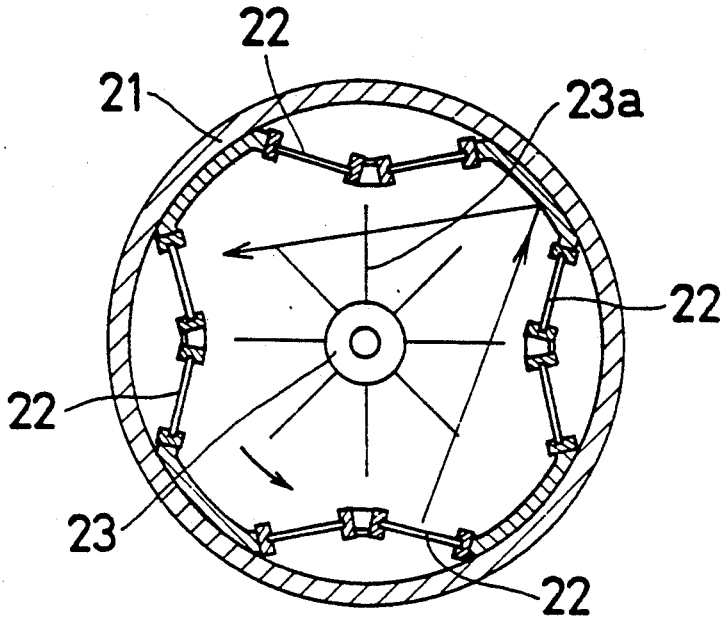
Fig. 13 (Related Art)
FIG. 13 is a plane view of a conventional energy converter.
Figure 14:
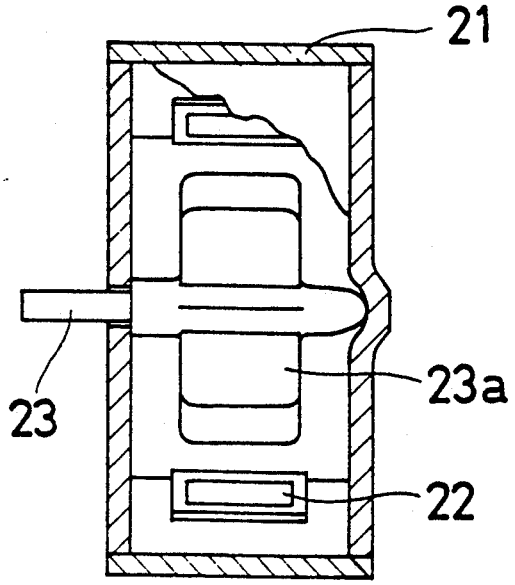
Fig. 14 (Related Art)
FIG. 14 is a vertical cross-sectional view of the device in FIG. 13.

In order to obtain 100% in reflection coefficient, a gas is available instead of the metal reflecting member. FIG. 12 shows another embodiment in which the sound wave is set to be reflected at the border portion between a rubber layer 14 and an air layer 13.

For obtaining the maximum torque, half of the energy of the sound wave is to be absorbed at its first incidence in the cover 5b and the remaining half of the energy is to be absorbed after its reflection. By adjusting any of the frequency of the resonator, the distance between the resonator and the cover, rating of the cover 5b, the sound wave energy can be converted into a rotational movement or other movement in efficiency.

As mentioned above, no friction is generated during energy conversion as seen in the conventional manner, which results in the establishment of an efficient energy conversion. The present invention enables the energy converter to be used in a liquid and such usage increases the cooling effect of the converter. Furthermore, pressure can be derived from the sound wave at its incidence and reflection, which enables flexibility in design such as a location of the rotor.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. An energy converter for converting sound energy into kinetic energy comprising:

source means for radiating an acoustic radiation pressure; and a body having a cover member and a reflecting member which are arranged in layers, the body receiving the acoustic radiation pressure such that the acoustic radiation pressure passes through the cover member and is transmitted to the reflecting member along a tangential direction thereof.

2. An energy converter as recited in claim 1, wherein the source means includes a pair of resonators mounted in opposing relation with respect to the body.

3. An energy converter as recited in claim 1, wherein the source means includes a first pair of resonators mounted in opposing relation with respect to the body for moving the body in one direction and another pair of resonators mounted in opposing relation with respect to the body for moving the body in an opposite direction.

4. An energy converter as recited in claim 1, wherein a vibration frequency of the source means is not less than 1 MHz.

5. An energy converter as recited in claim 1, wherein a vibration frequency of the source means is 10 MHz or less.

6. An energy converter as recited in claim 1, wherein a vibration frequency of the source means ranges from 1 MHz through 10 MHz.

7. An energy converter as recited in claim 1, wherein the source means includes a pair of electrodes each of which is obtained by CVD method.

8. An energy converter as recited in claim 1, wherein the source means includes a pair of electrodes each of which is obtained by sputtering manner.

9. An energy converter as recited in claim 1, wherein said source means comprises two spaced apart resonators, one of said resonators radiating an acoustic radiation pressure to cause the body to move in one direction and the other resonator radiating an acoustic radiation pressure to cause the body to move in an opposite direction.

* * * * *